US005397169A

United States Patent [19]

Willans

[11] Patent Number: 5,397,169

[45] Date of Patent: Mar. 14, 1995

[54] HANDLE APPARATUS

[76] Inventor: Keith Willans, 56 Tyn-Y-Parc Road, Whitchurch, Cardiff, CP4 6BP, United Kingdom

[21] Appl. No.: 49,857

[22] Filed: Apr. 20, 1993

[30] Foreign Application Priority Data

Apr. 25, 1992 [GB] United Kingdom ..... 9209023

[51] Int. Cl.[6] ..... A61G 5/14

[52] U.S. Cl. ..... 297/411.23; 297/DIG. 10

[58] Field of Search ..... 297/411.1, 411.2, 411.32, 297/411.23, DIG. 10; 135/66, 67, 74

[56] References Cited

U.S. PATENT DOCUMENTS

| | | | |
|---|---|---|---|
| 1,890,102 | 12/1932 | Urquhart | 297/411.23 |
| 2,773,542 | 12/1956 | Chasin | 297/DIG. 10 X |
| 3,206,249 | 9/1965 | Gateley | 297/411.23 |
| 3,553,746 | 1/1971 | Seiger . | |
| 3,739,793 | 6/1973 | Wilson . | |
| 4,843,661 | 7/1989 | Skibinski | 297/DIG. 10 X |
| 5,226,439 | 7/1993 | O'Keeffe et al. | 297/DIG. 10 X |

FOREIGN PATENT DOCUMENTS

| | | |
|---|---|---|
| 0058643 | 8/1982 | European Pat. Off. . |
| 0109347 | 5/1984 | European Pat. Off. . |
| 0217662 | 4/1987 | European Pat. Off. . |
| 1090661 | 11/1967 | United Kingdom . |
| 1262751 | 2/1972 | United Kingdom . |
| 1594514 | 7/1981 | United Kingdom . |
| 2244919 | 11/1991 | United Kingdom . |

*Primary Examiner*—Peter R. Brown
*Attorney, Agent, or Firm*—Larson and Taylor

[57] ABSTRACT

There is provided handle apparatus comprising a pair of spaced handle arrangements 10, each comprising a handle portion 11 and a support portion 12. The support portions 12 are connected by adjustable rails 42 and have lower sections 46 which in use extend under a chair. Movable back stop members 46 are adjustable along the lower sections 46.

The apparatus is thus anchored relative to the chair and a user can lift himself from the chair using the grip sections 17 of the handle portions 11.

17 Claims, 13 Drawing Sheets

Figure 1:
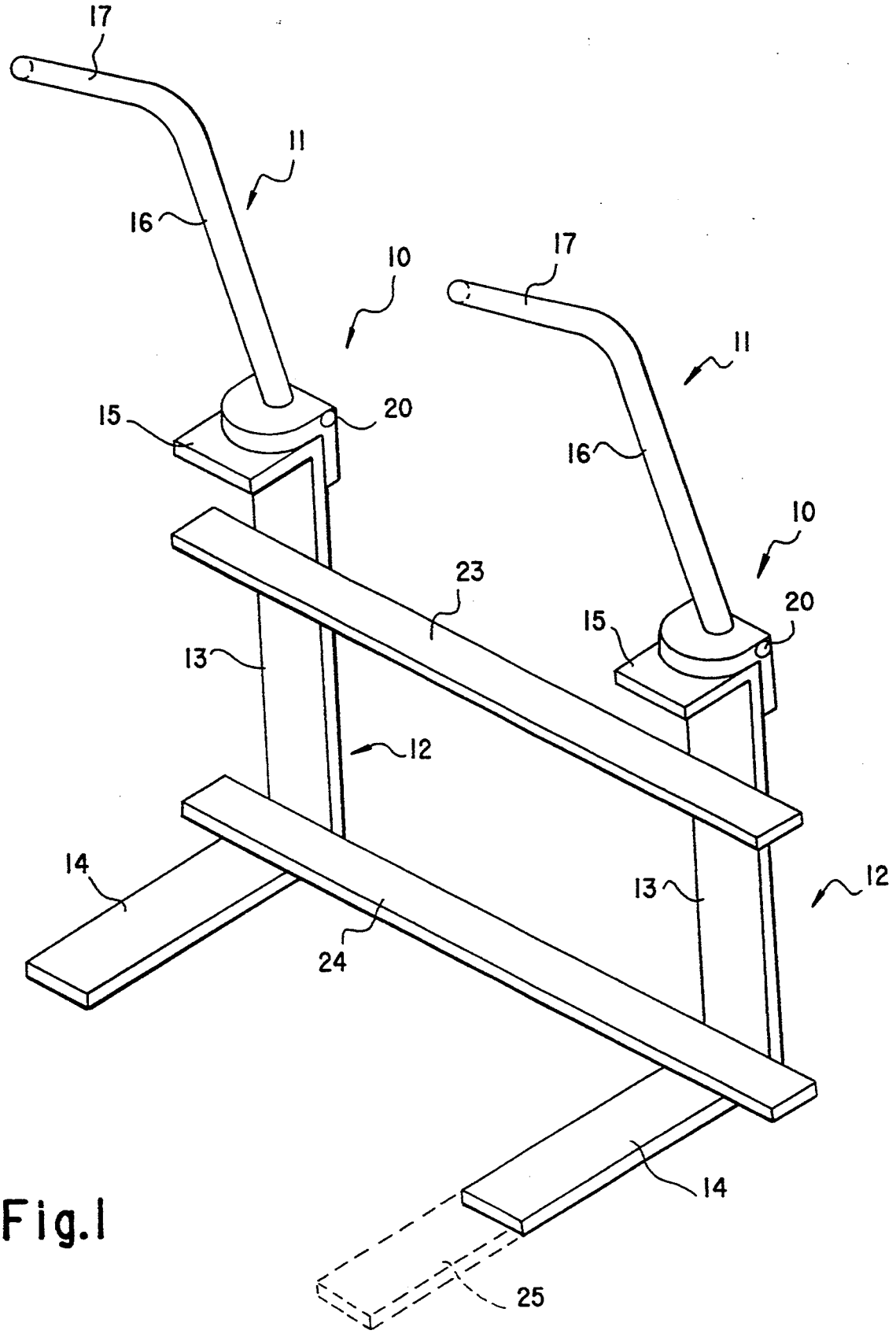

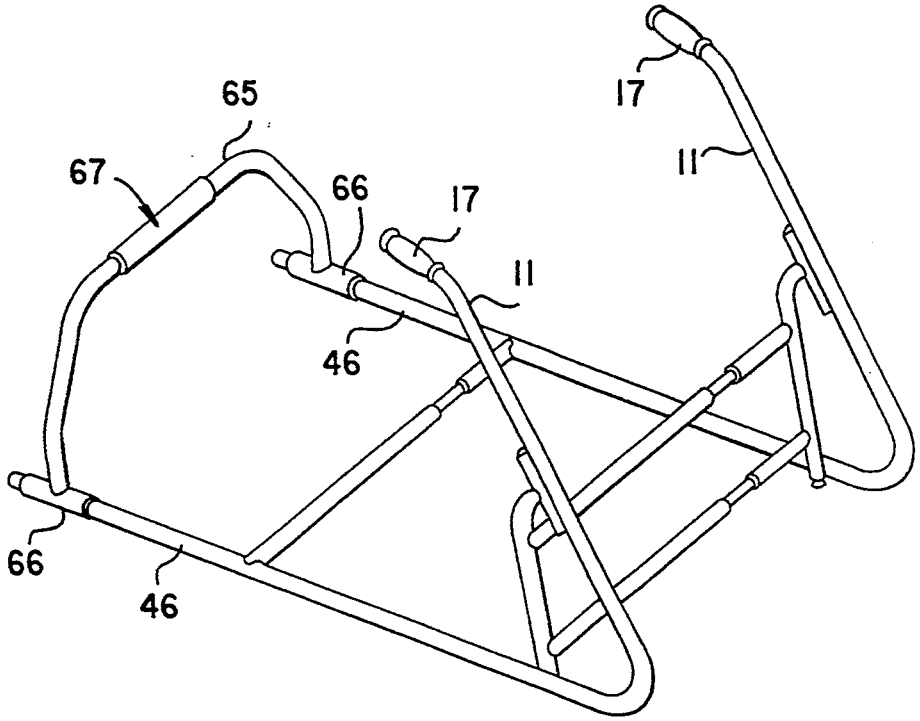
Fig.11
Fig.12
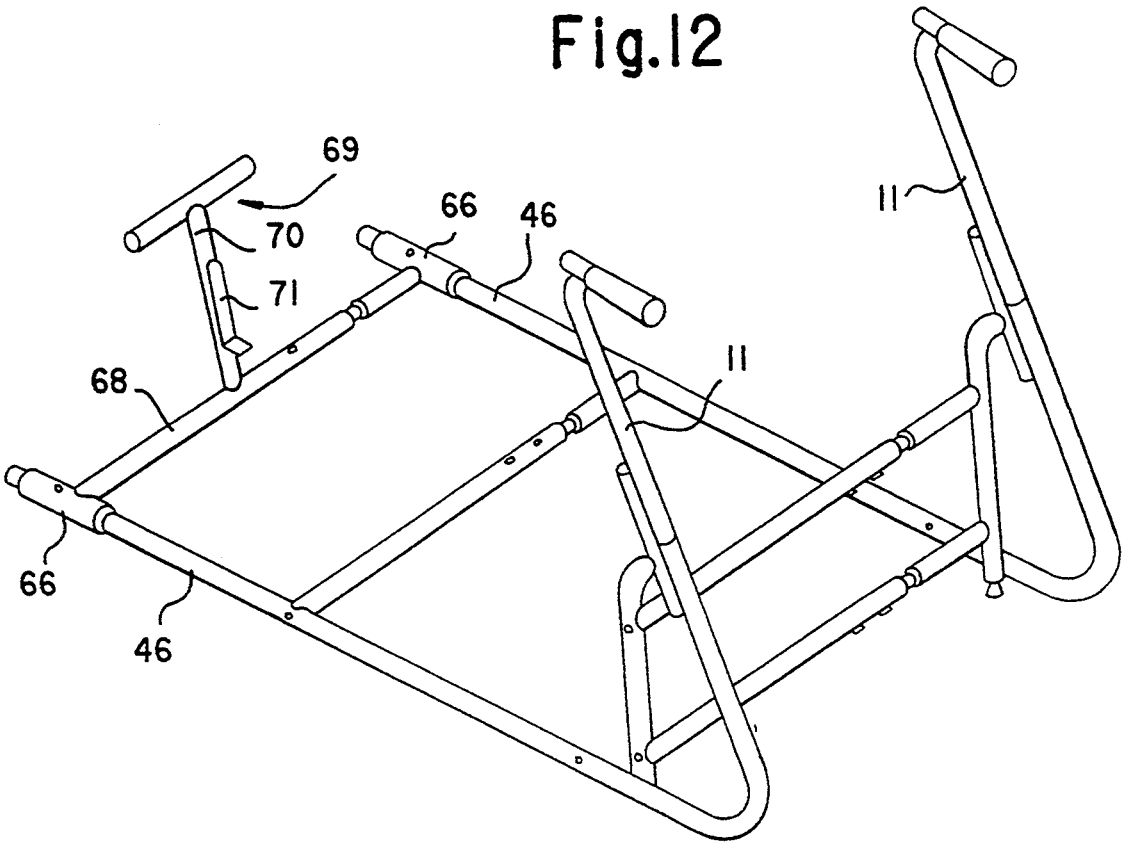

Fig.15
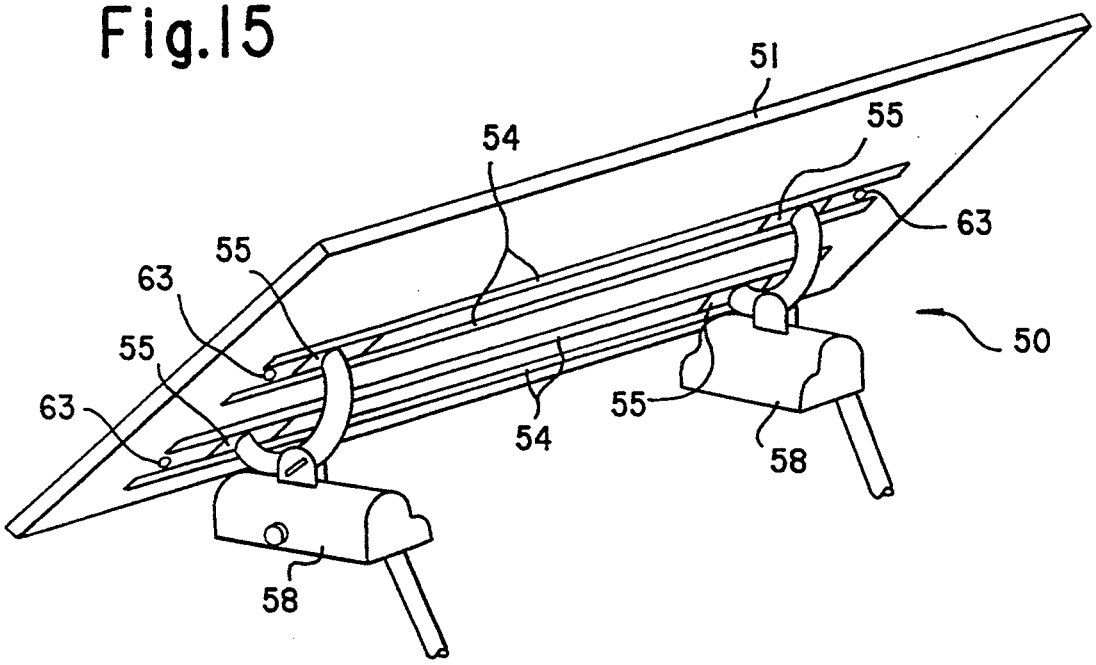
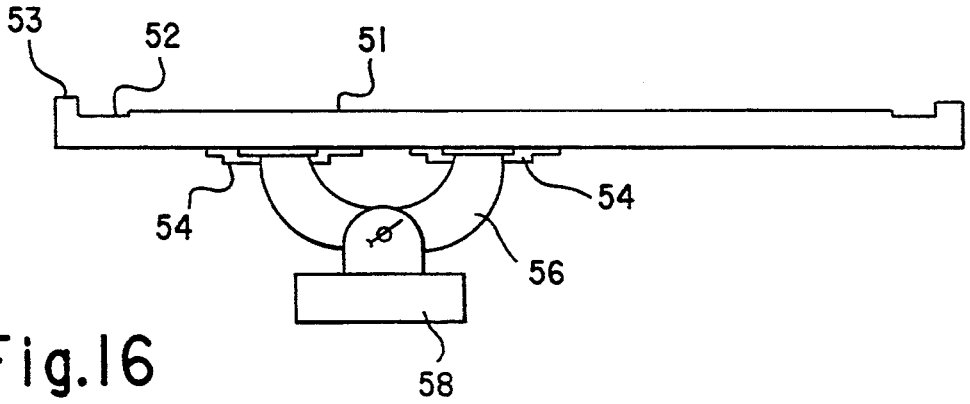
Fig.16

HANDLE APPARATUS

This invention relates to handle apparatus and more particularly to such apparatus which better enables the self movements of a person out of or from a chair. In this specification the term chair should be taken to include all forms of seating or reclining apparatus such as chairs, armchairs, settees, recliners, beds, sofa-beds, bed-settees, etc.

Older persons and those suffering from a weakness in the lower limbs have great difficulty in rising from some chairs without possible danger to themselves or without safe assistance from another person. This difficulty is more pronounced the lower the actual seating surface.

In many instances safe rising by a person would be greatly improved if the chair was made with higher arms, but this would of course detract from the pleasing aesthetics of the usually accepted designs. In any event it would be of little use if the user preferred to sit or recline on a sofa where the arms are far apart.

According to the present invention there is provided handle apparatus comprising a pair of handle arrangements, the handle arrangements having respective support portions which, in use, are connected together and having handle portions, said apparatus being adapted such that, in use, movement relative to a chair or other seating device is substantially prevented and the handle arrangements are spaced generally along an edge of the chair.

Such an arrangement would enable many more persons to enjoy the comfort of a low chair in preference to a high chair. The user would be able to sit and rise to a standing position with some measure of independence and with less direct assistance. In some embodiments the chair anchors the handle apparatus to prevent movement.

Preferably the handle portion is hingedly connected to the support portion. The handle portions could also be detachable from the support portion.

In some arrangements the support portion is provided with holes to facilitate attachment to the chair by bolts/screws. The support portion may comprise one or more sections which, in use, extend beneath the chair. These sections may have an upstanding element at their rear most ends for engaging a rear facing surface of the chair whilst the support portions engage the forward facing surface of the chair. Conveniently the upturned element is movable along said sections and is securable against movement relative thereto. No fasteners need be used with such an arrangement.

In preferred arrangements the two support portions are connected together by rails, which are adjustable in length so as to vary the distance between the support portions. Also the height of the handle portion from the chair may be varied.

The handle portion could also be adapted to carry attachments such as a tiltable table.

Figure 2:
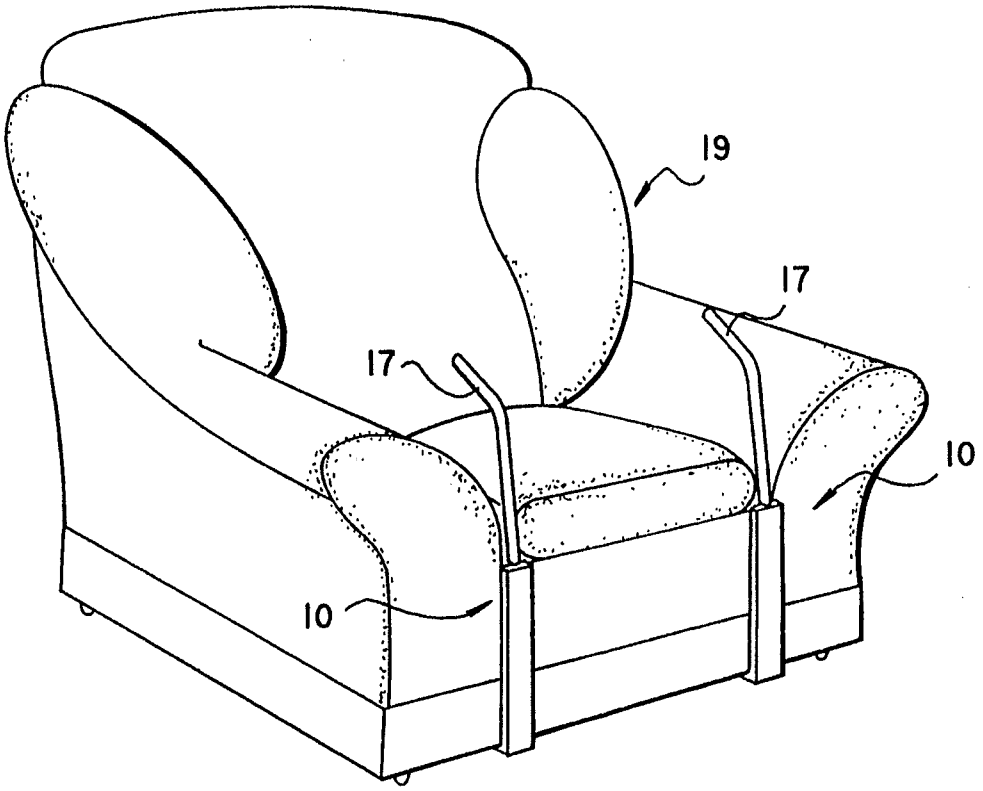
Figure 3:
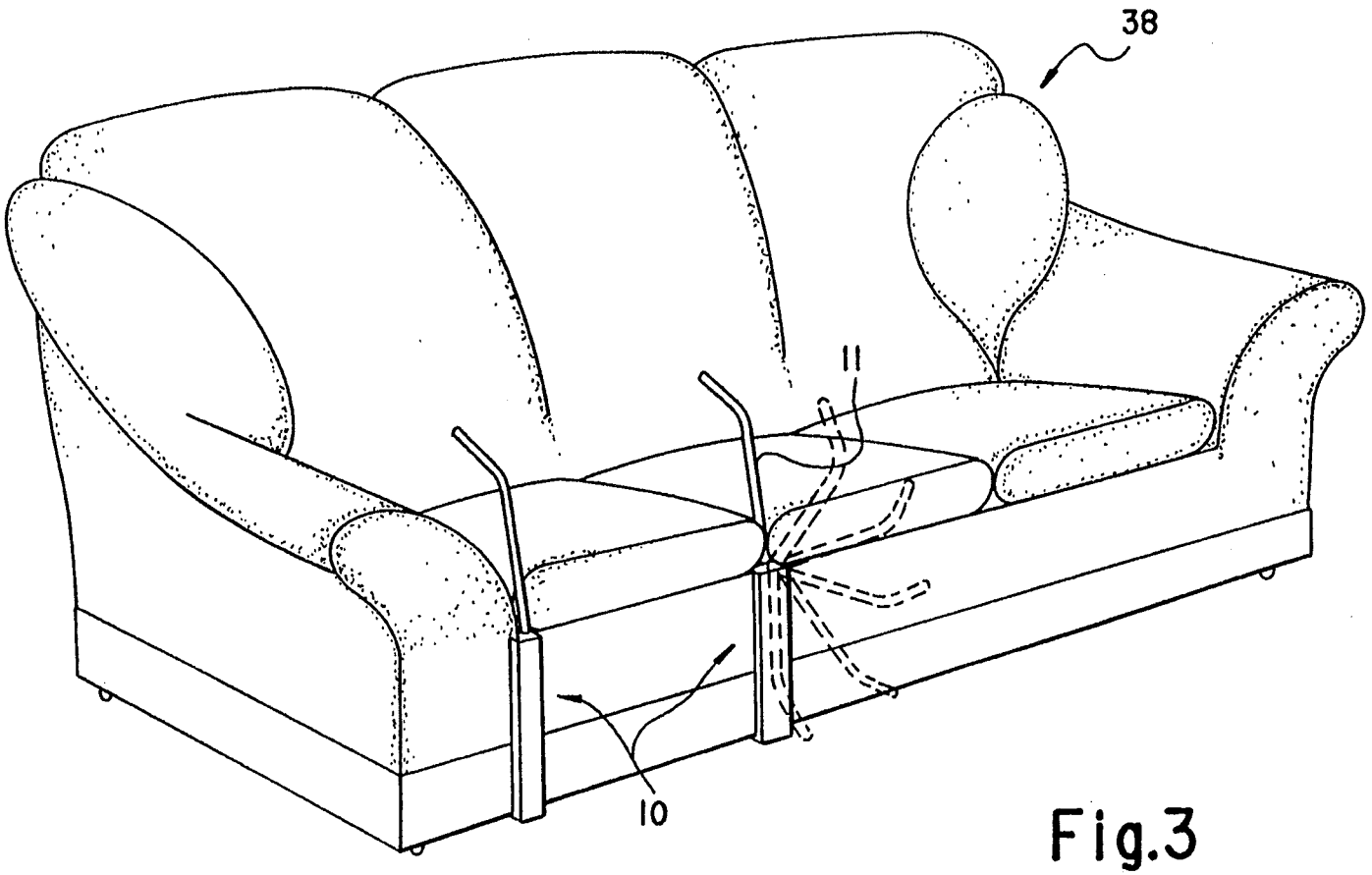
Figures 4, 6:
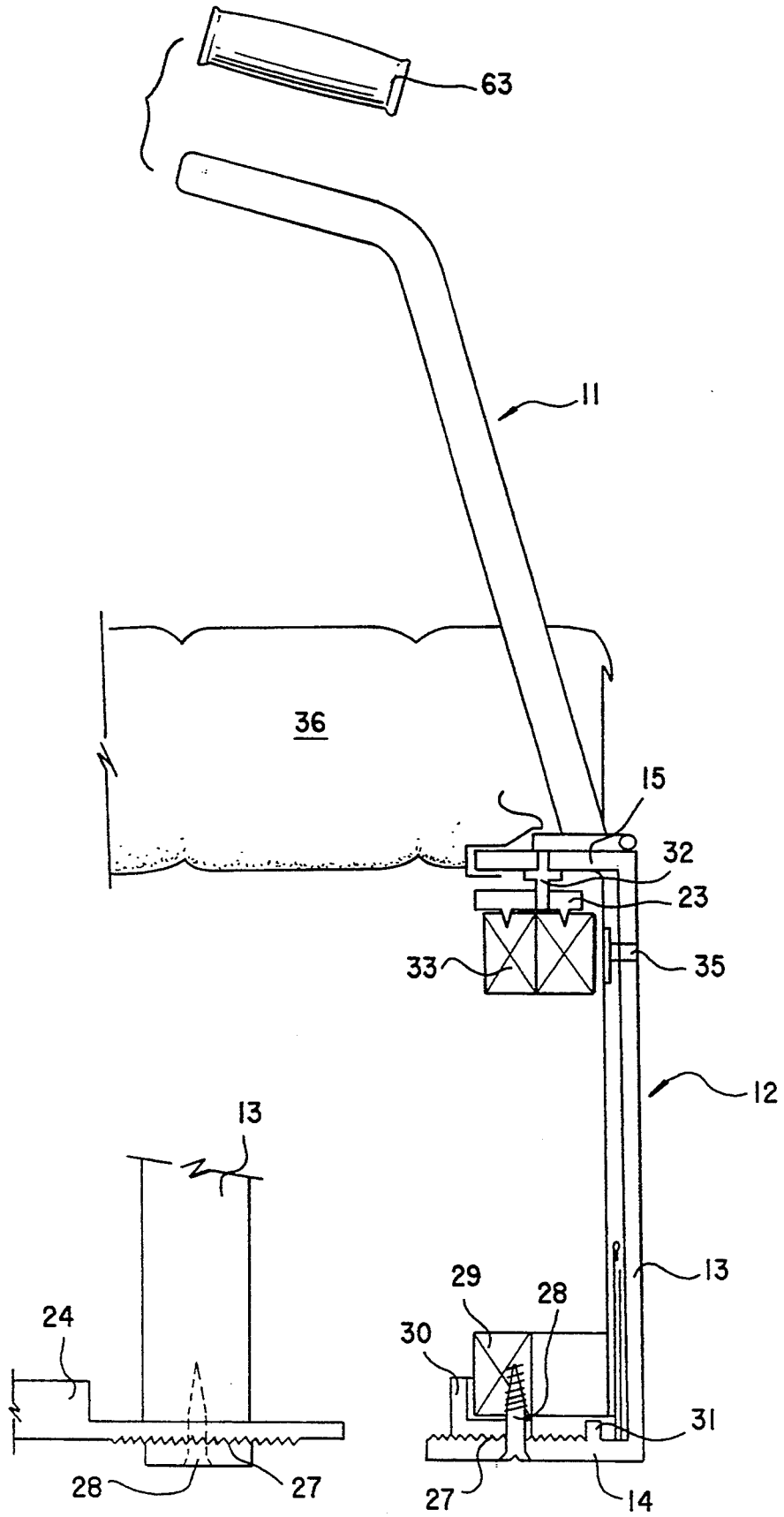
Figure 5:
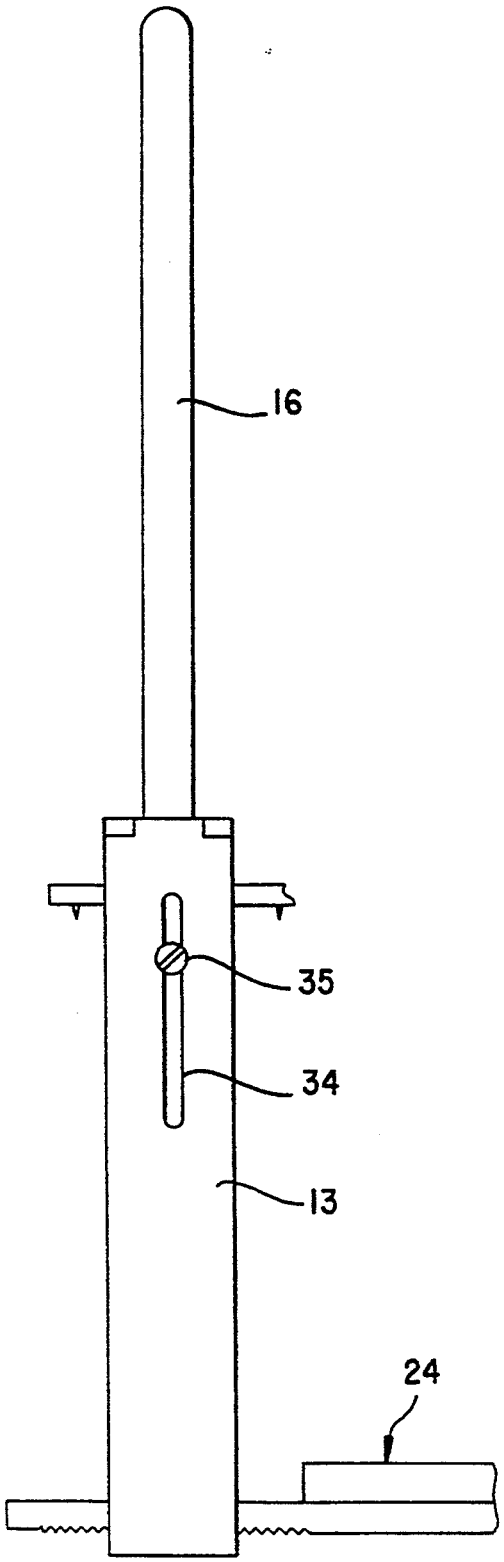
Figure 7:
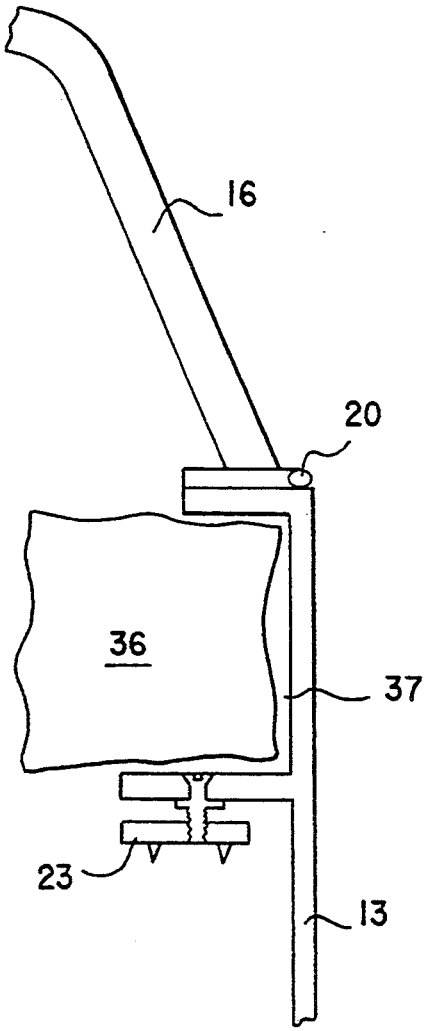
Figure 8:
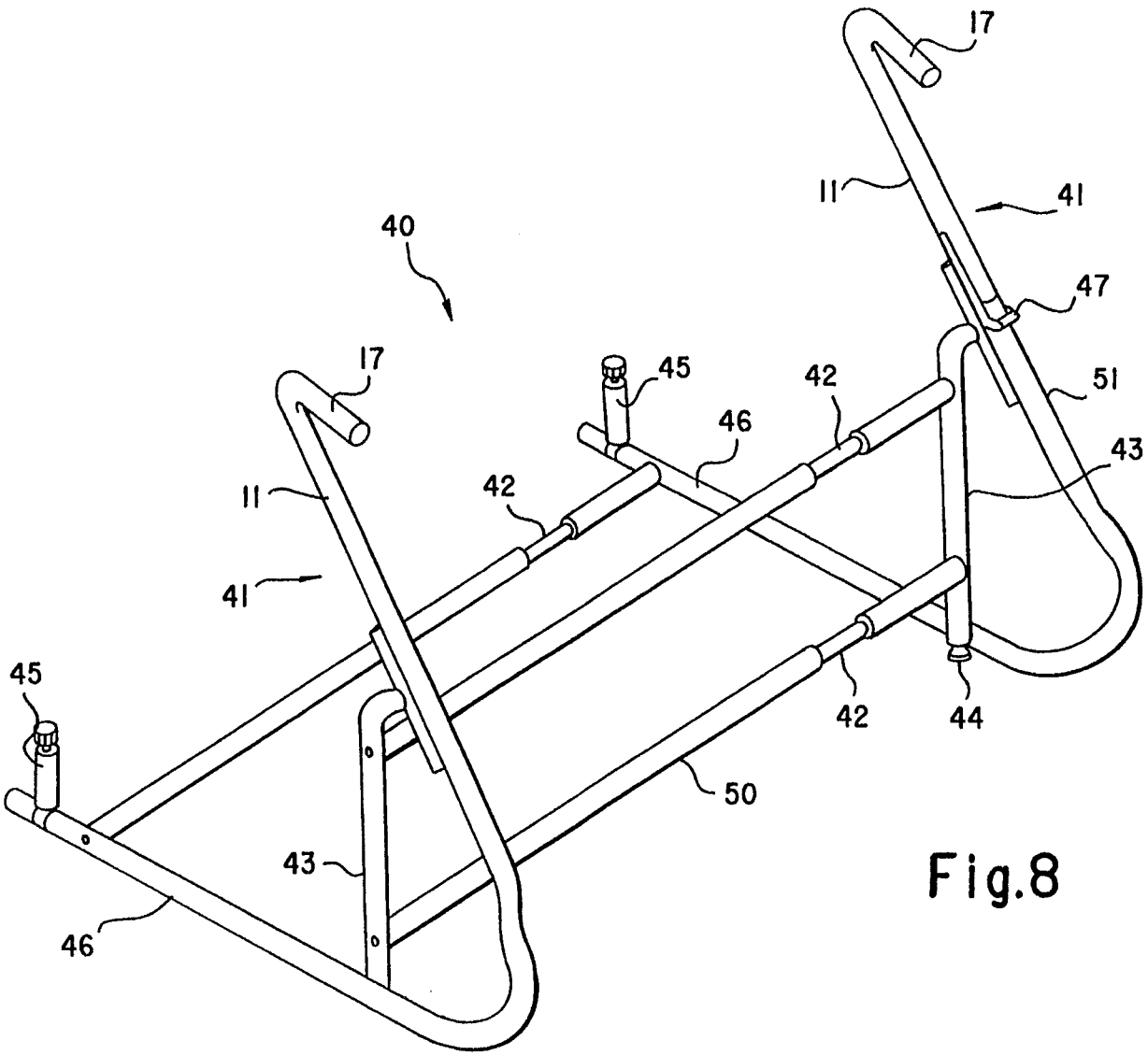
Figure 9:
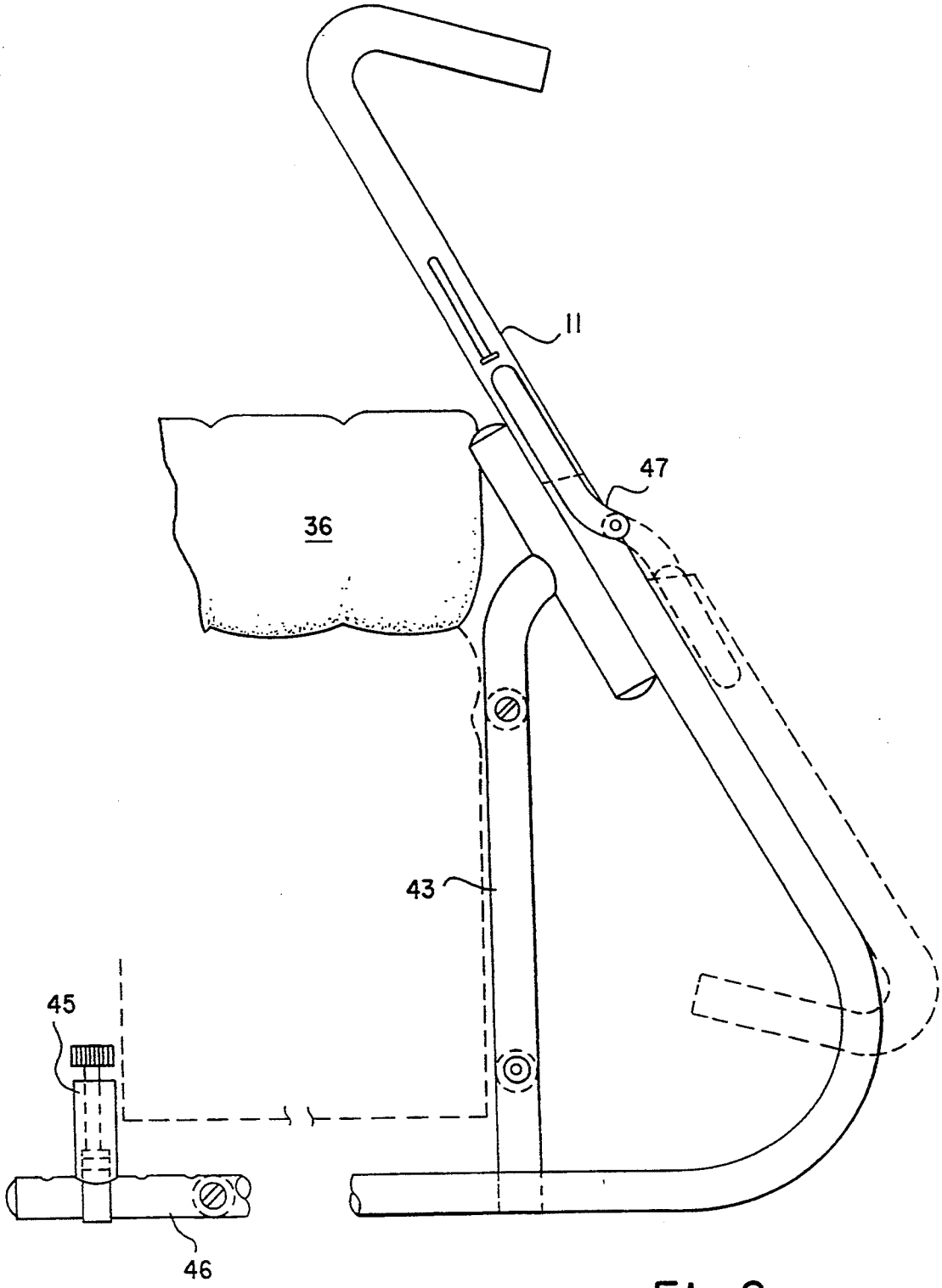
Figure 10:
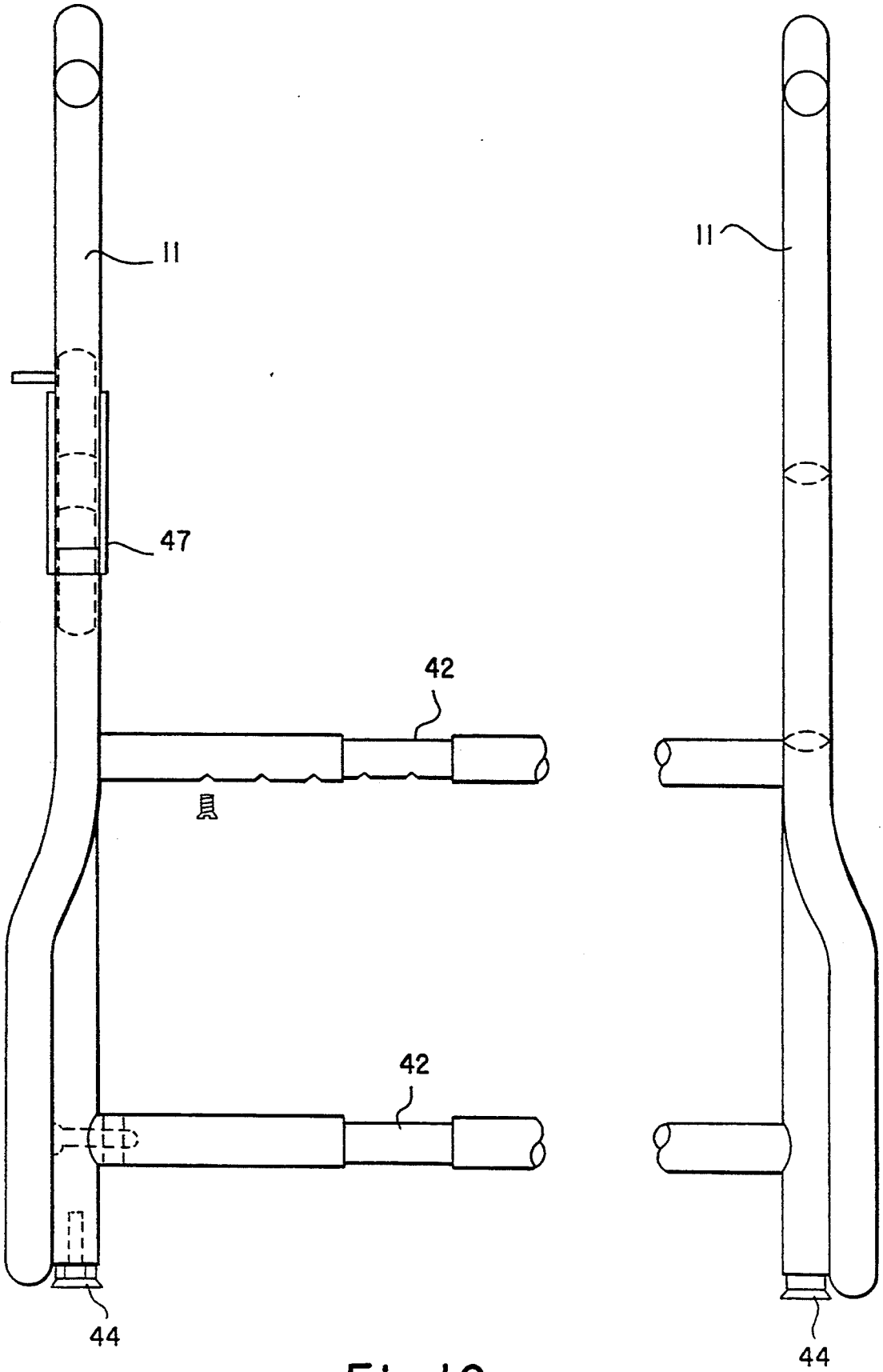
Figure 13:
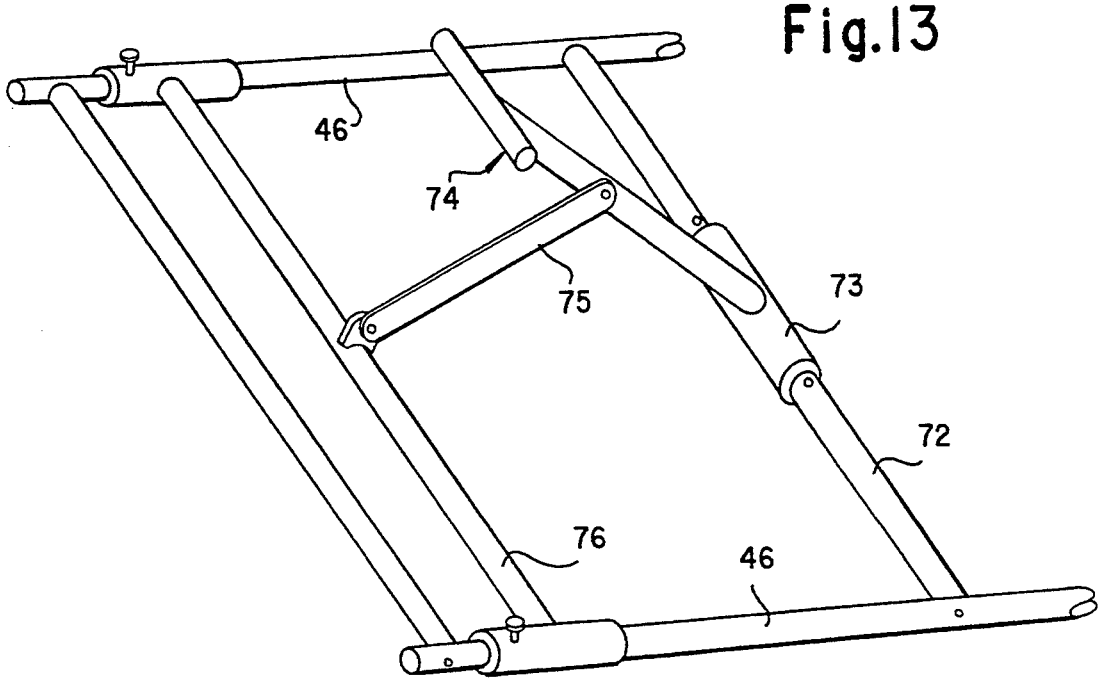
Figure 14:
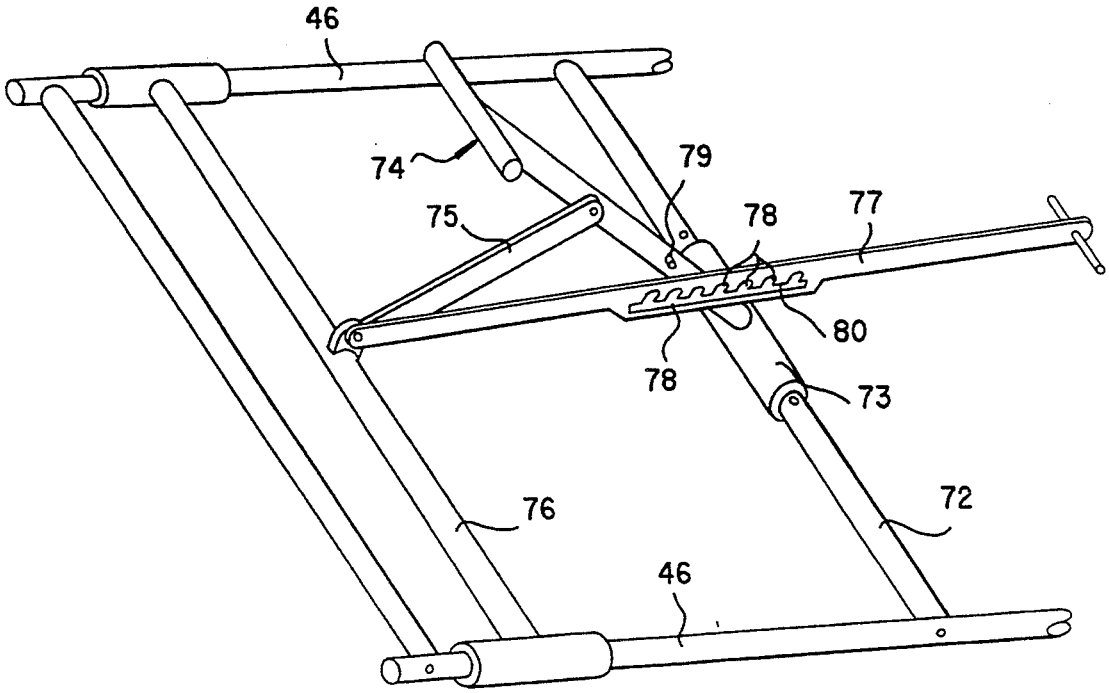
Figure 17:
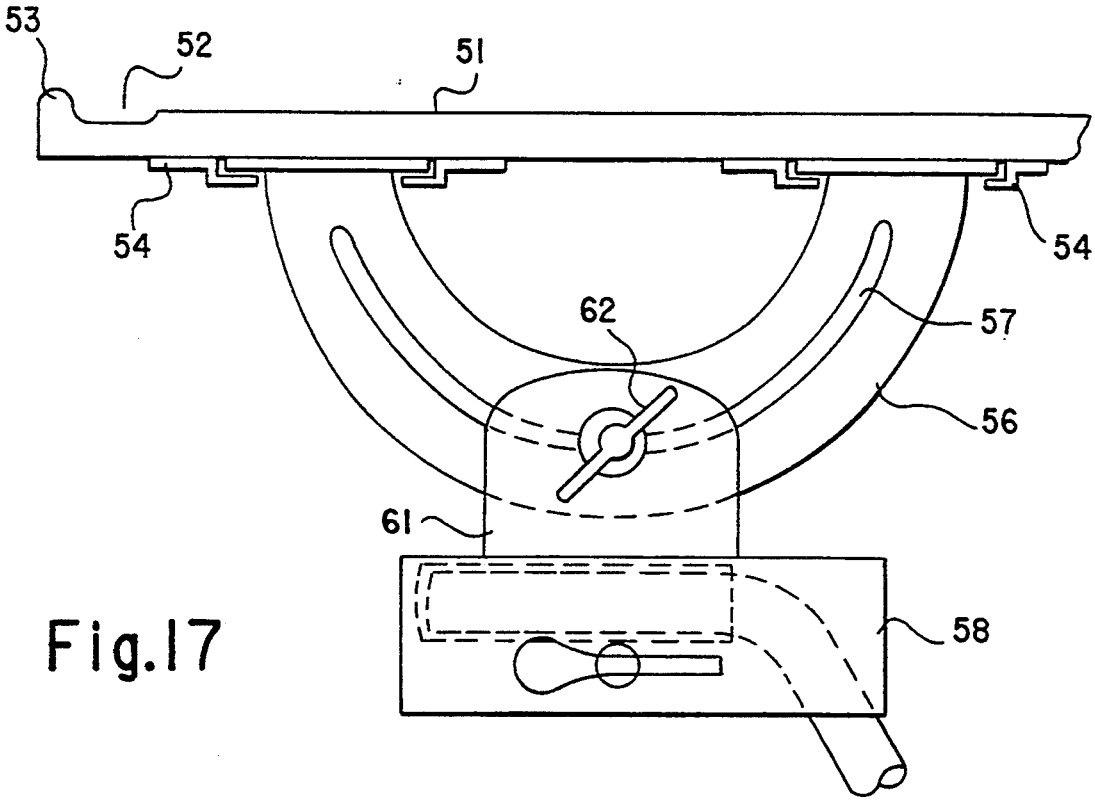
Figure 18:
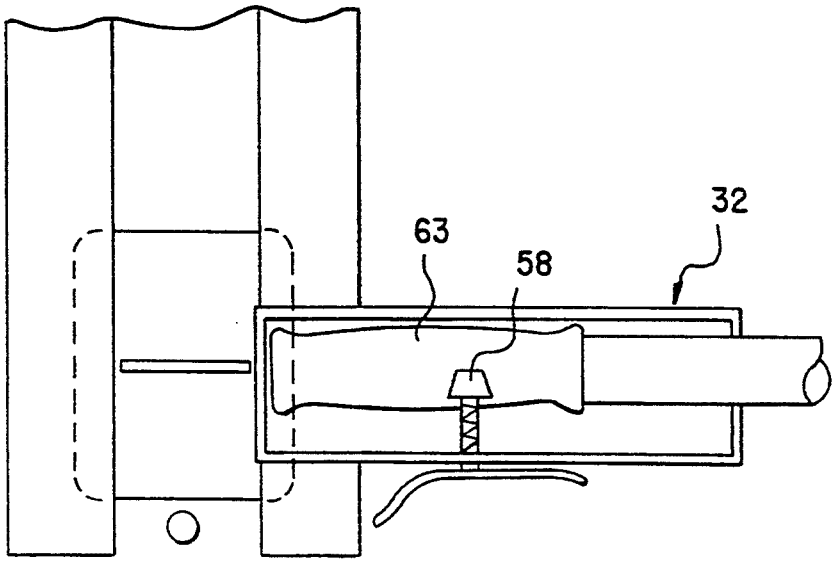
Figure 19:
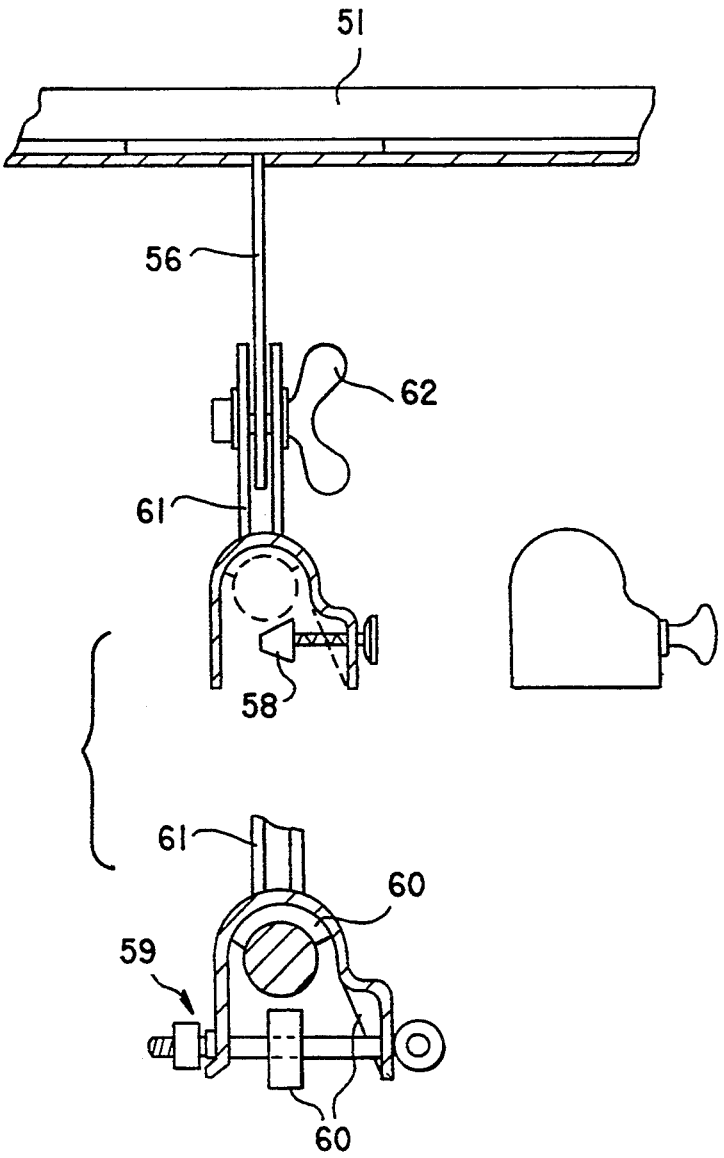

Several embodiments of the invention will now be described in more detail. The description makes reference to the accompanying drawings in which:

FIG. 1 shows a rear perspective view of handle apparatus according to the present invention, FIG. 2 illustrates the handle apparatus according to FIG. 1 in perspective, and in use on an armchair, FIG. 3 shows in perspective, the handle apparatus of FIG. 1 attached to the front of a sofa, FIG. 4 shows a further handle apparatus viewed from the side, FIG. 5 shows in part the FIG. 4 apparatus viewed front, FIG. 6 Shows in part the FIG. 4 apparatus viewed from the rear, FIG. 7 shows in part a modified version of the FIG. 4 apparatus viewed from the side, FIG. 8 shows a further embodiment in perspective, FIG. 9 illustrates the FIG. 8 apparatus viewed from the side, FIG. 10 shows the FIG. 8 apparatus viewed from the front, FIG. 11 shows a perspective view of an alternatively embodiment similar to FIG. 8, FIG. 12 shows a perspective view of a further alternative embodiment similar to FIG. 8, FIG. 13 shows a partial rear perspective view of a further embodiment, FIG. 14 shows a partial rear perspective view of a still further embodiment, FIG. 15 illustrates an attachment for the handle apparatus in perspective viewed from the front and underside, FIG. 16 shows the attachment viewed from the side, FIG. 17 shows the attachment's tilting mechanism viewed from below, and FIG. 19 shows the attachment's tilting mechanism viewed from the front, and in section.

Referring to FIGS. 1 to 3 there is shown handle apparatus, comprising a pair of handle arrangements 10, each comprising a handle portion 11 and a support portion 12. The support portion 12 comprises three plate sections 13, 14, 15. The upper and lower sections 15, 14 are secured at right angles to the vertical section 13. The handle portion 11 has a riser section 16 and an angled grip section 17. The riser section is secured to the upper section 15 of the support portion 12 by means of a hinge 20.

The handle arrangements 10 are spaced apart by upper and lower connecting rails 23, 24. The locations of these rails 23, 24 with respect to the vertical sections 13 is such that the rails 23, 24 just pass by the upper and lower frame sections of the chair. The rails 23, 24 can, therefore, be secured directly to the frame of the chair to anchor the handle arrangement to the chair. Also the lower sections 14 may be extended rearwards at 25 so as to enable the lower sections 14 to be secured to the lower rear frame of the chair.

In FIG. 2 there is shown an armchair 19 to which has been attached the handle apparatus. The grip sections 17 are disposed well above the standard arms of the armchair and facilitate the safe, self-rising of the chair's occupant.

FIG. 3 shows the handle apparatus on a sofa 38. The handle portion 11 of one is shown being moved into its lowered position. This lowering enables the person to move their legs on to the sofa 38 so as to take up a reclining position. The lowered position of the handle portions 11 also results in the sofa looking more aesthetically pleasing.

In other embodiments the handle portions 11 may be welded to the support portions 12. Alternatively some adjustable, disconnectable means may be provided.

In the handle apparatus shown in FIGS. 4 to 6 the upper surface of the lower section 14 and the lower surface of the lower rail 24 are serrated at 27 and the spacing between the handle arrangements 10 can be varied. The combination can then be secured by a screw 28 passing through the lower section 14 and the lower rail 24 and into the lower front frame section 29 of the chair. The serrations 27 are thus caused to become tightly engaged and prevent relative movement. In this embodiment the lower rail 24 is also provided with an upwardly extending edge 30 to locate against the rear face of the lower front frame section 29. A stop 31 is also provided on the lower section 14 to support the front frame section 29 and limit forward movement of the lower rail 24.

At the upper end of the support portion 12, a toothed upper rail 23 is provided. This rail 23 is screw threadedly attached to screw means 32 which is located in the upper section 15, but which is prevented from axial movement relative to the upper section 15. To secure the upper end of the support portion 12 the screw means 32 is actuated and this urges the teeth of the upper rail 23 into engagement with the upper front frame section 33 of the chair. In the vertical section 13 is provided a slot 34 and a screw 35 can be used to attach the vertical section to the upper front frame section 33.

The seat cushion 36 is then placed over the upper section 15.

FIG. 7 shows vertical section 13 extended at 37 such that the hinge 20 of the arrangement is, in use, disposed above the cushion 36 of the chair.

In FIGS. 8 to 10 there is shown handle apparatus 40 made largely from tubular elements. The same general theories apply. The two handle arrangements 41 are adjustably spaced from each other by virtue of lateral supports 50 having slidable connections 42. The vertical sections 43 have feet 44 which are adjustable in height. The device 40 has upright members 45 at the rear for engaging the back of the chair. These upright members 45 are adjustable in position along lower sections 46. In this embodiment the upright members 45 incorporate threaded bolts which can be screwed into one of a series of holes on the lower sections 46. The device 40 can, therefore, be generally anchored with respect to the chair, by virtue of the loose clamping between front and rear members.

One of the handle portions 11 is hingedly connected at 47 to the anterior section 51. This is of course optional and could be provided on either one or both sides. FIG. 9 shows the folded position of the handle portion 11 in dotted lines.

This arrangement requires no permanent anchoring to the chair, but uses the weight of the user on the feet 44 to prevent the handle apparatus from sliding in use. It could also use the weight of the chair to anchor the apparatus.

In FIG. 11, the apparatus is very similar to that shown in FIGS. 8 to 10 except the upright members 45 are replaced by a C-shaped member 65. This member 65 is attached at both ends to sleeves 66 which are slidable along the lower sections 46 and lockable relative thereto. The width of the member 65 is variable at 67.

In FIG. 12, the apparatus is again very similar to that shown in FIGS. 8 to 10 except the upright members 45 are replaced by a variable length bar 68. The bar 68 terminates in sleeves 66 which are slidable along the lower sections 46 and lockable relative thereto. Extending from the bar 68 is a T shaped member 69. On the upright 70 of the T-shaped member 69 is a bracket 71 which is movable through a range of positions. The T-shaped member and the bracket 71 are very versatile in engaging the rear portions of furniture thereby to enhance the anchoring of the apparatus.

In FIG. 13 the handle arrangements are not shown. A fixed rail 72 is provided between the lower sections 46 and a sleeve 73 is rotatably mounted on the rail 72. A T-shaped engaging element 74 is secured to the sleeve 73 and a bracing arm 75 is pivotally attached at one end to the element 74 and at the other end to a sliding rail 76, slidably mounted on the lower sections 46. Movement of the sliding rail towards the fixed rail 72 raises the element 74 and the slidable rail 76 can be locked using locking nuts for example. The element 74 can, therefore, be made to firmly engage the underside of a piece of furniture such as a bed. This engagement ensures that improved anchoring of the apparatus is effected.

FIG. 14 shows an arrangement similar to that shown in FIG. 13. In FIG. 14, however, a handle bar 77 is attached to the slidable rail to make movement of this rail easier. The handle bar 77 has serrations 78 opening into an elongate slot 80 so that the slot 80 can capture a pin 79 on the T-shaped element which pin can be locked into one of the serrations 78. The position of the T-shaped element 74 can therefore be varied.

In FIGS. 15 to 19 there is shown an accessory for the handle arrangements described above. The accessory is in the form of a table 50 having a work top 51 which has channels 52 and projecting lips 53 to retain objects and maybe even some spillage. The underside of the work top is provided with runners 54 in which are slidably disposed bearing plates 55 connected to a pair of guide plates 56 each having an arcuate slot 57. Each runner has an end stop 63.

Clamps 58 are provided for the grip section 17 of each handle portion 11. The clamps can be secured by any suitable means such as spring loaded wedges 58 or restraining screw bolt 59 and positioners 60. 0n each clamp is a plate 61 having a serrated surface for gripping the associated guide plate 56 securely when a wing nut 62 and bolt which passes through the slot 57, are tightened.

The work top can thus be secured at a range of suitable angles including horizontal.

It will be appreciated that the above embodiments are by way of example only and practical alternatives are possible.

The handle apparatus can be attached before or after the chairs have been upholstered. Clearly much of the apparatus will remain hidden if the upholstery is completed after attachment.

Hand grips 63 of any suitable material such as plastics or rubber can of course be provided on any of the grip sections.

Also the handle portions could be detachable and even of variable length.

I claim:

1. Handle apparatus for use with a seating device comprising:

a pair of handle arrangements each said handle arrangement having a lower section adapted for being positioned on a floor beneath the seating device and an anterior section extending upwardly from said lower section having a handle portion extending over the seating device, a lateral support rigidly connecting each of said pair of handle arrangements to the other handle arrangement at sufficient separation distance to allow a person to position legs therebetween, a pair of vertical section means positioned for contacting a front of the seating device to prevent the handle apparatus from moving rearward relative to the seating device, each of said vertical section means being rigidly attached to a respective one of said anterior sections at one end and positioned to contact the floor at the other end in response to downward force being applied to the anterior section by the person to prevent the handle apparatus from moving relative to the floor, and contact means connected to said lower section of one of said handle arrangements for contacting a portion of the seating device to prevent the handle apparatus from moving forward relative to the seating device.

2. A handle apparatus as in claim 1 wherein said contact means is adjustably connected to said lower section of one of said handle arrangements to allow adjustment to fit a variety of seating devices.

3. A handle apparatus as in claim 1 wherein said contact means is an upright member.

4. Handle apparatus as claimed in claim 3 wherein has a bracket the height of which is adjustable.

5. A handle apparatus as in claim 1 wherein said lateral support is adjustable in length to allow the separation distance between said pair of handle arrangements to be varied to fit a variety of seating devices and persons.

6. A handle apparatus as in claim 1 wherein one of said handle portions is hingedly connected to its respective said anterior section to allow said one of said handle portions to pivot downwardly to allow the person to more easily lift legs over said anterior section.

7. A handle apparatus as in claim 1 wherein each of said vertical means has a foot at the end of said vertical section that contacts the floor, said foot being adjustable in height.

8. A handle apparatus as in claim 1 wherein each of said anterior sections further comprises a grip section positioned to allow the person to comfortably exert downward force on said anterior section.

9. Handle apparatus as claimed in claim 1 wherein one or both handle portions are detachable from the respective anterior sections.

10. Handle apparatus as claimed in claim 1 wherein said contact means comprises a C-shaped member having free ends which are attached to sleeves which said sleeves are slidable along said lower sections.

11. Handle apparatus as claimed in claim 8 wherein the slidable sleeves have a number of set positions.

12. Handle apparatus as claimed in claim 1 wherein said contact means comprises a T-shaped member attached to a bar extending between said lower sections and terminating in sleeves which said sleeves are slidable along said.

13. Handle apparatus as claimed in claim 1 wherein an arrangement is provided to engage an underside of the chair.

14. Handle apparatus as claimed in claim 10 comprising a fixed rail interposed between said lower sections, an engaging member being hingedly mounted on said fixed rail, a bracing member having two ends pivotally connected to said engaging member at one end and connected to a second rail at the other end, said second rail being movable relative to said lower sections and securable relative thereto.

15. Handle apparatus as claimed in claim 12 wherein locking nuts are provided between the second rail and each of said lower sections.

16. Handle apparatus as claimed in claim 12 wherein a handle bar is attached to said second rail, which handle bar is securable relative to the fixed rail.

17. Handle apparatus as claimed in claim 14 wherein a series of slots are provided on the handle bar for engagement member with a pin provided on said engaging member.

* * * * *